US009899751B2

(12) United States Patent
Wu et al.

(10) Patent No.: US 9,899,751 B2
(45) Date of Patent: Feb. 20, 2018

(54) ELECTRICAL CONNECTOR LIMITER STRUCTURE OF WIRE CONNECTION TERMINAL

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Cherng Shin Wu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/454,250

(22) Filed: Mar. 9, 2017

(65) Prior Publication Data

US 2017/0264027 A1 Sep. 14, 2017

(30) Foreign Application Priority Data

Mar. 11, 2016 (TW) ..... 105203357 U

(51) Int. Cl.
*H01R 4/48* (2006.01)

(52) U.S. Cl.
CPC ..... *H01R 4/4809* (2013.01)

(58) Field of Classification Search
CPC .. H01R 4/4809; H01R 4/4845; H01R 4/4818; H01R 4/4827; H01R 13/11; H01R 13/111
USPC ..... 439/834, 867
See application file for complete search history.

(56) References Cited

U.S. PATENT DOCUMENTS 2,428,022 A * 9/1947 Harrison ..... H01R 13/111 439/834
4,006,960 A * 2/1977 Lacan ..... H01R 4/4809 439/625
4,474,417 A * 10/1984 Millhimes ..... H01R 13/113 439/271
4,679,876 A * 7/1987 Regla ..... H01R 4/4809 439/426
5,322,983 A * 6/1994 Tseng ..... H01H 15/06 200/547
5,454,730 A * 10/1995 Tozuka ..... H01R 4/4818 439/438
5,529,516 A * 6/1996 Wu ..... H01R 9/26 439/654
6,776,670 B2 * 8/2004 Suss ..... H01R 4/4818 439/834

(Continued)

*Primary Examiner* — Abdullah Riyami
*Assistant Examiner* — Vladimir Imas
(74) *Attorney, Agent, or Firm* — Rosenberg, Klein & Lee

(57) ABSTRACT

An electrical connector limiter structure of wire connection terminal is easily operable to enhance the stability of the operation and motion of metal leaf springs. The wire connection terminal includes conductive components mounted in the insulation case and electrical connector assembled with the conductive components. The electrical connector has a limiter for receiving the metal leaf springs and restricting moving path thereof. The limiter is partitioned to define a first space and a second space with fully closed peripheries, in which the metal leaf springs are mounted. The wiring circuits or conductive wires coming from an apparatus can be easily directly plugged into the first and second spaces of the limiter to insert with the metal leaf springs. The limiter serves to prevent the metal leaf springs from deflecting in operation.

25 Claims, 8 Drawing Sheets

(56) References Cited

U.S. PATENT DOCUMENTS

| | | | | |
|---|---|---|---|---|
| 7,485,016 | B2 * | 2/2009 | Ishigami | H01R 4/184 439/748 |
| 7,625,253 | B2 * | 12/2009 | Eppe | H01R 4/4836 439/835 |
| 8,454,396 | B2 * | 6/2013 | Horn | H01F 41/076 439/874 |
| 8,771,027 | B2 * | 7/2014 | Zhang | H01R 4/48 439/835 |
| 9,391,386 | B2 * | 7/2016 | Bishop | H01R 13/428 |
| 9,614,299 | B2 * | 4/2017 | Ludwig | H01R 4/28 |
| 2009/0128734 | A1 * | 5/2009 | Cho | G02F 1/133604 362/97.1 |
| 2010/0216336 | A1 * | 8/2010 | Quiter | H01R 4/4809 439/567 |
| 2017/0110264 | A1 * | 4/2017 | Wu | H01H 1/58 |
| 2017/0110267 | A1 * | 4/2017 | Wu | H01H 13/14 |
| 2017/0264027 | A1 * | 9/2017 | Wu | H01R 4/4809 |

* cited by examiner

ELECTRICAL CONNECTOR LIMITER STRUCTURE OF WIRE CONNECTION TERMINAL

BACKGROUND OF THE INVENTION

1. Field of the Invention

The present invention relates generally to an electrical connector limiter structure of wire connection terminal, and more particularly to an electrical connector limiter assembled with metal leaf springs. The limiter has higher rigidity and is able to help in fixing and restricting moving path of the metal leaf springs.

2. Description of the Related Art

A conventional wire connection terminal device has an insulation case (generally made of plastic material), a metal component (or so-called electrical conductive component) and a metal leaf spring. The metal component and the metal leaf spring are enclosed in the insulation case to press and electrically connect with a conductive wire plugged in the terminal device. The terminal device can be mounted on an operation panel or a distributor box of an electronic or electrical apparatus as an electrical wiring connection device.

With respect to the operation and application of the assembling structure of the conventional wire connection terminal, when the conductive wire is plugged into the case and the wire connector, the conductive wire will first press down the metal leaf spring. Then, the metal leaf spring applies an elastic force to the conductive wire to bite or hold the conductive wire together with the wire connector so as to electrically connect with the conductive wire. It often takes place that when the conductive wire is plugged into the case, due to the large number of plug-in operation and human negligence, the metal bare end of the conductive wire thrusts and damages the case or deflects the metal leaf spring to scrape and break the case and fail to stably hold the conductive wire. In order to improve the above problem, a conventional wire connector limiter is assembled with the wire connector to restrict the moving path of the metal leaf spring.

However, as well known by those who are skilled in this field, such limiter assembled with the wire connector or the conductive plate has a relatively complicated structure and it is troublesome and time-consuming to process the limiter. Moreover, in the case that two or more conductive wires need to be connected, in practice, it will be necessary to arrange two or more connection terminals and wire connectors for correspondingly connecting with every conductive wire. This will lead to increase of the total volume of the wiring device and occupy extra space. Also, this is unbeneficial to the development and design trend of miniaturized wire connection terminal. This is not what we expect.

To speak representatively, the above reveals some shortcomings existing in the conventional electrical connection terminal or wire connector and metal leaf spring and the relevant assembling design.

In case the structure and assembly of the wire connector and the metal leaf spring are redesigned to be different from the conventional wire connection terminal, the use form of the wire connection terminal can be changed to practically widen the application range thereof. For example, in the condition that the development and design trend of miniaturized terminal device are satisfied and the volume of the terminal device is not increased, the fixing structures or assembling relationship of the conventional wire connector and metal leaf springs are changed, whereby the structure of the terminal device is easy to manufacture and operate so as to improve the shortcomings of the conventional terminal device that the operation is troublesome and time-consuming and the structure is relatively complicated.

In addition, a wire connection terminal device (or electrical connector) equipped with a limiter is provided. The limiter has a first space and a second space with fully closed peripheries for truly receiving the metal leaf springs and restricting the moving path of the metal leaf springs. Moreover, at least two conductive wires can be side by side plugged into the electrical connector to respectively assemble with the metal leaf springs. In order to truly restrict and guide the metal leaf springs, the peripheries of the first and second spaces of the limiter are fully closed. This is specially considered and required.

This is because in the case that the peripheries of the first and second spaces of the limiter are not fully closed, the limiter will be unable to have sufficient structural strength. Under such circumstance, when a first conductive wire is plugged in, the limiter is bent and compressed. In this case, some sidewalls of the limiter are apt to deform to affect the plug-in operation of the second conductive wire. As a result, the normal (swinging) function and motional form of the metal leaf springs will be affected or interfered with. All these are the shortcomings of the conventional wire connection terminal.

SUMMARY OF THE INVENTION

It is therefore a primary object of the present invention to provide an electrical connector limiter structure of wire connection terminal is easily operable to enhance the stability of the operation and motion of metal leaf springs. The wire connection terminal includes conductive components mounted in the insulation case and electrical connector assembled with the conductive components. The electrical connector has a limiter for receiving the metal leaf springs and restricting moving path thereof. The limiter is partitioned to define a first space and a second space with fully closed peripheries, in which the metal leaf springs are mounted. The wiring circuits or conductive wires coming from an apparatus can be easily directly plugged into the first and second spaces of the limiter to insert with the metal leaf springs. The limiter serves to prevent the metal leaf springs from deflecting in operation.

To achieve the above and other objects, the electrical connector limiter structure of the present invention includes a limiter. The limiter includes a first side, a second side connected with the first side, a third side connected with the second side and a fourth side connected with the third side to together form a rectangular frame structure. The first side is bent toward the third side to form a first subsidiary side. The first subsidiary side extends to a position in adjacency to the third side so as to define a first space with a fully closed periphery. The fourth side is bent toward the second side and extends to form a fifth side. The fifth side and the first side are positioned on the same plane face. The fifth side is bent toward the third side to form a second subsidiary side. The first and second subsidiary sides are side by side arranged in parallel to each other. The second subsidiary side extends to a position in adjacency to the third side so as to define a second space with a fully closed periphery.

In the above electrical connector limiter structure, at least the second side and the first subsidiary side help in restricting the moving path of one metal leaf spring and the fourth side and the second subsidiary side help in restricting the moving path of the other metal leaf spring.

In the above electrical connector limiter structure, the third side is formed with a window and the first subsidiary side and/or the second subsidiary side extends into the window. Accordingly, the window can restrict and bear the first subsidiary side and/or the second subsidiary side to form a stable structure without deflection. Accordingly, in the operation process, the metal leaf springs will not deflect or shake so as to together truly restrict the moving path of the metal leaf springs.

The present invention can be best understood through the following description and accompanying drawings, wherein:

DETAILED DESCRIPTION OF THE PREFERRED EMBODIMENTS

Figure 2:
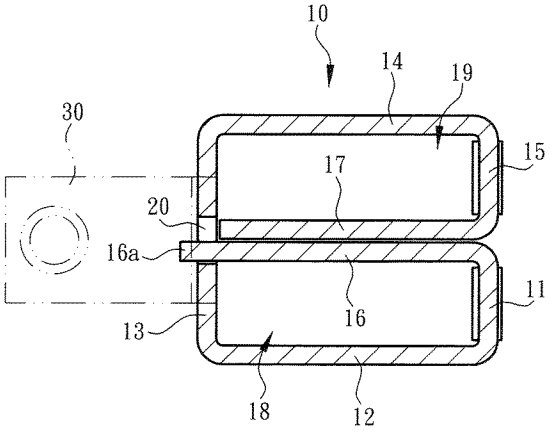
FIG. 2 is a sectional view according to FIG. 1, showing that the first subsidiary side and/or the second subsidiary side extends through the window.
Figure 1:
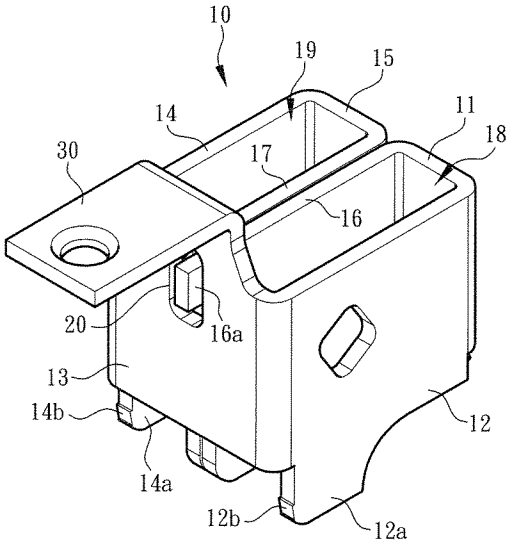
FIG. 1 is a perspective view of the electrical connector limiter of the present invention, showing the structure of the electrical connector limiter.
Figure 3:
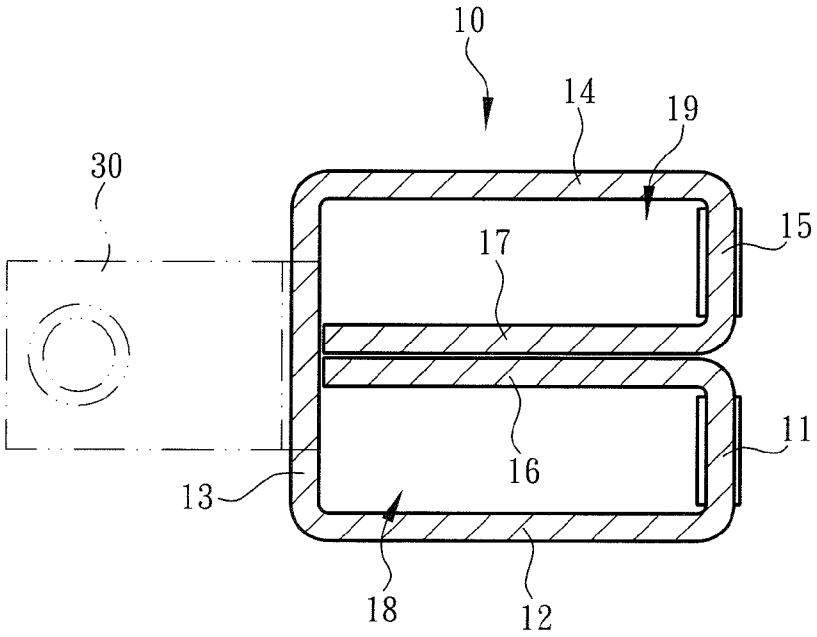
FIG. 3 is a sectional view of a modified embodiment of the present invention according to FIG. 2, showing that the first and second subsidiary sides extend to the third side to define the first and second spaces with fully closed peripheries.

Please refer to FIGS. 1, 2 and 3. The electrical connector limiter structure of wire connection terminal of the present invention is mountable in an insulation case and assembled with a conductive support, an electrical connector and metal leaf spring to form a pushbutton switch device, electrical connection terminal or the like device for pivotally connecting with a wiring circuit or conductive wire coming from an electronic or electrical apparatus. (This pertains to prior art and thus is not shown in the drawings). Basically, according to the application form or mode, the limiter 10 permits at least two conductive wires to plug in and assemble with the metal leaf springs.

In a preferred embodiment, the limiter 10 is selectively made of a flat blank material with higher rigidity or hardness, such as iron, steel, etc. The flat blank material is processed to form a rectangular frame structure of the limiter 10 as shown in FIGS. 1, 2 and 3.

As shown in the drawings, the limiter 10 includes a first side 11, a second side 12 connected with the first side 11, a third side 13 connected with the second side 12 and a fourth side 14 connected with the third side 13. The first side 11 is bent toward the third side 13 to form a first subsidiary side 16. (For example, the first side 11 and the first subsidiary side 16 can contain an acute angle, a right angle or an obtuse angle.) The first subsidiary side 16 extends to a position in adjacency to the third side 13 so as to define a first space 18 with a fully closed periphery.

As shown in the drawings, the fourth side 14 is bent toward the second side 12 and extends to form a fifth side 15. The fifth side 15 and the first side 11 are positioned on the same plane face. The fifth side 15 is bent toward the third side 13 and extends to forma second subsidiary side 17. (For example, the fifth side 15 and the second subsidiary side 17 can contain an acute angle, a right angle or an obtuse angle.) The second subsidiary side 17 extends to a position in adjacency to the third side 13 so as to define a second space 19 with a fully closed periphery. The first and second subsidiary sides 16, 17 are side by side arranged in parallel to each other. Metal leaf springs can be respectively received and assembled in the first and second spaces 18, 19, whereby the metal leaf springs can swing within the limiter 10 (or the first and second spaces 18, 19) to securely hold the conductive wires.

In this embodiment, at least the second side 12 and the first subsidiary side 16 help in restricting the moving path of one metal leaf spring and the fourth side 14 and the second subsidiary side 17 help in restricting the moving path of the other metal leaf spring.

As shown in FIGS. 1 and 2, the third side 13 is formed with a window 20 and the first subsidiary side 16 (and/or the second subsidiary side 17) is formed with a protrusion end **16*a*. The total length of the first subsidiary side 16 and the protrusion end 16*a* is larger than the length of the second subsidiary side 17. Therefore, the protrusion end 16*a* can extend into or pass through the window 20. In this case, the window 20 can restrict and bear the first subsidiary side 16 (and/or the second subsidiary side 17**) to form a stable structure without deflection. Accordingly, in the operation process, the metal leaf springs will not deflect or shake so as to together truly restrict the moving path of the metal leaf springs.

FIG. 3 shows that the length of the first subsidiary side 16 is equal to the length of the second subsidiary side 17.

It should be noted that the length of the first and second subsidiary sides 16, 17 at least is such that the first and second subsidiary sides 16, 17 extend to a position close to or adjacent to the third side 13 (or the protrusion end 16*a* of the first subsidiary side 16 passes through the window 20 of the third side 13). Under such circumstance, the first and second spaces 18, 19 with the fully closed peripheries can be truly defined to make the limiter 10 have sufficient or optimal structural strength for resisting against or bearing the plug-in operation of the conductive wire. Only in this case, the metal leaf springs can be truly received and guided to restrict the moving path thereof.

In a preferred embodiment, leg sections 12*a*, 14*a* protrude from the bottom ends or bottom sections of the second and fourth sides 12, 14 of the limiter 10. In addition, finger sections 12*b*, 14*b* are formed on (lateral sides) of the leg sections 12*a*, 14*a*. The finger sections 12*b*, 14*b* help in securely assembling the limiter 10 with the metal leaf springs (or the conductive support, electrical connector, etc.)

Also, as shown in the drawings, an upper end of the third side 13 of the limiter 10 is (perpendicularly) bent to form an extension section 30. The extension section 30 can selectively electrically contact the other components of the switch device or the electrical connection terminal to close the circuit or non-contact with the other components to open the circuit.

Figure 4:
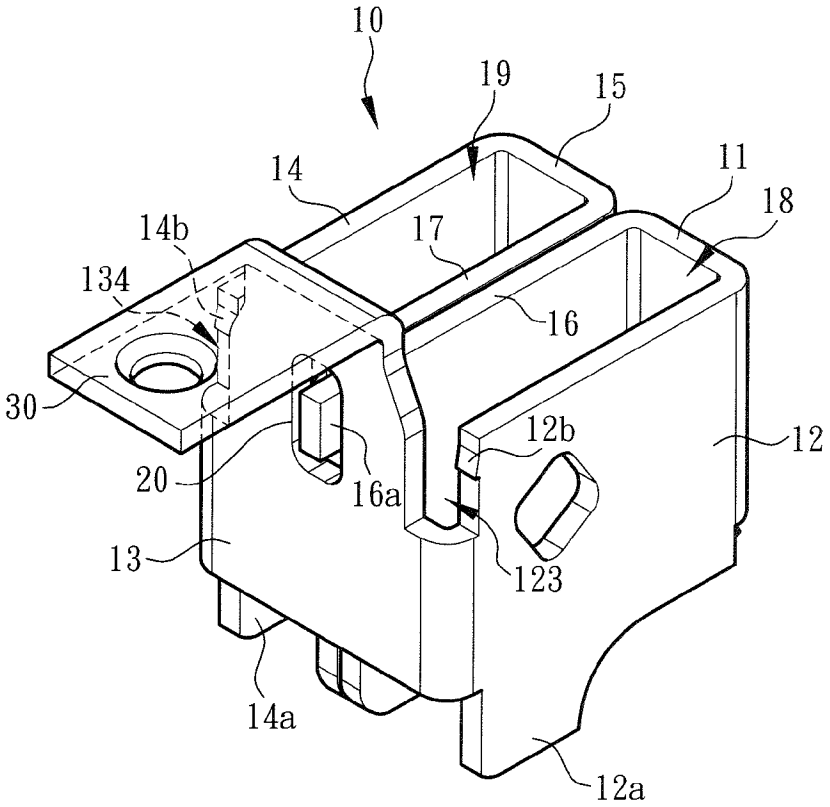
FIG. 4 is a perspective view of the electrical connector limiter of the present invention, showing that a notch is formed at a junction between the second and third sides and another notch is formed at a junction between the third and fourth sides.

Please now refer to FIG. 4. In the limiter 10, a notch 123 is formed at a junction between (the upper end) of the second side 12 and (the upper end) of the third side 13 and a notch 134 is formed at a junction between the third side 13 and the fourth side 14. The notches 123, 134 serve to help in securely assembling the limiter 10 with the metal leaf springs. FIG. 4 also shows that the finger sections 12*b*, 14*b* are respectively formed on the lateral side of the upper end of the second side 12 in a position adjacent to the notch 123 and the lateral side of the upper end of the fourth side 14 in a position adjacent to the notch 134. The finger sections 12*b*, 14*b* serve to cooperate with the notches 123, 134 to securely assemble with the metal leaf springs.

Figure 6:
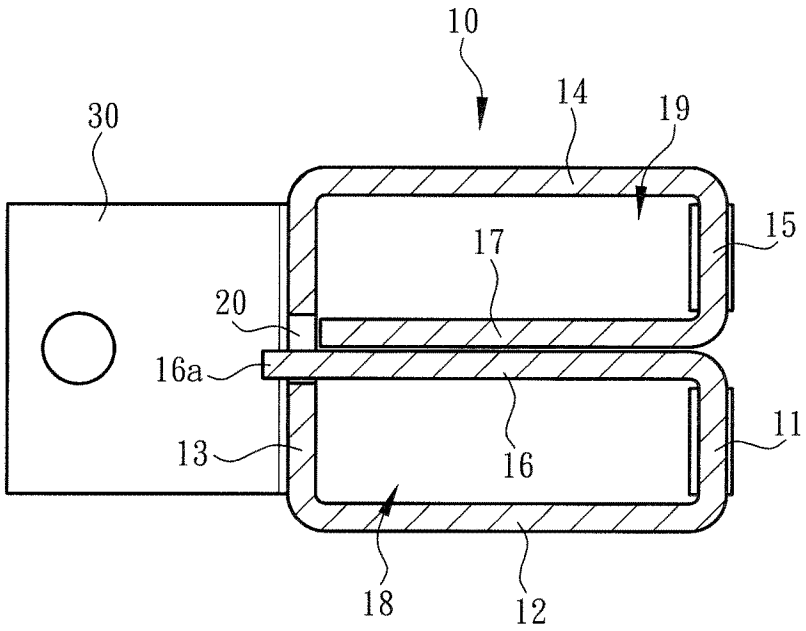
FIG. 6 is a sectional view according to FIG. 5.
Figure 5:
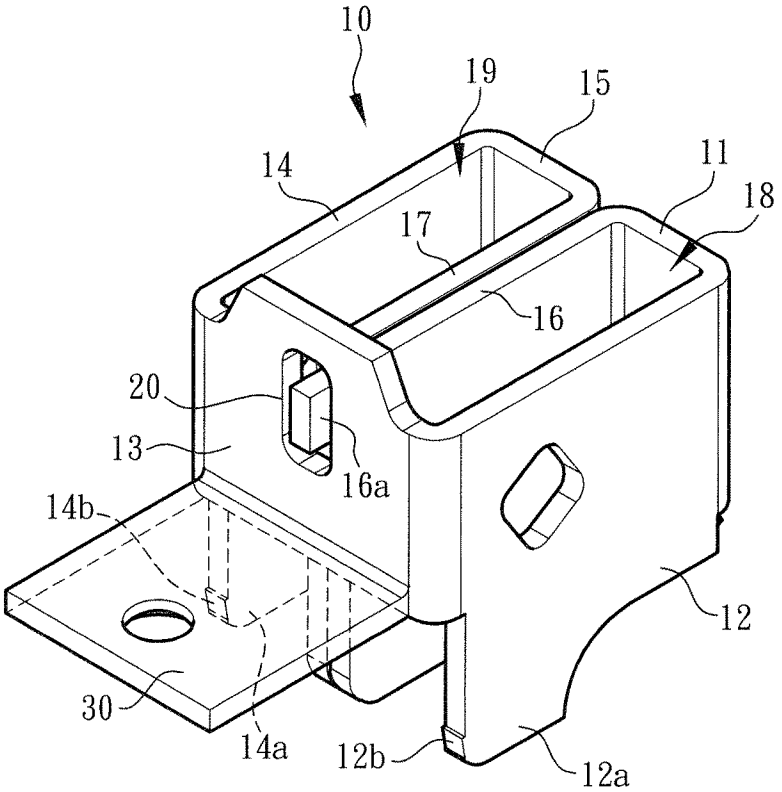
FIG. 5 is a perspective view of another embodiment of the electrical connector limiter of the present invention, showing that the third side is formed with an extension section and the finger sections are formed at the bottom ends of the second and fourth sides.

Please refer to FIGS. 5 and 6. In the limiter 10, the leg sections 12*a*, 14*a* are formed at the bottom ends of the second and fourth sides 12, 14 and the finger sections 12*b*, 14*b* are formed on (the lateral sides) of the leg sections 12*a*, 14*a*. In addition, a bottom end of the third side 13 is (perpendicularly) bent to form the extension section 30.

Figure 7:
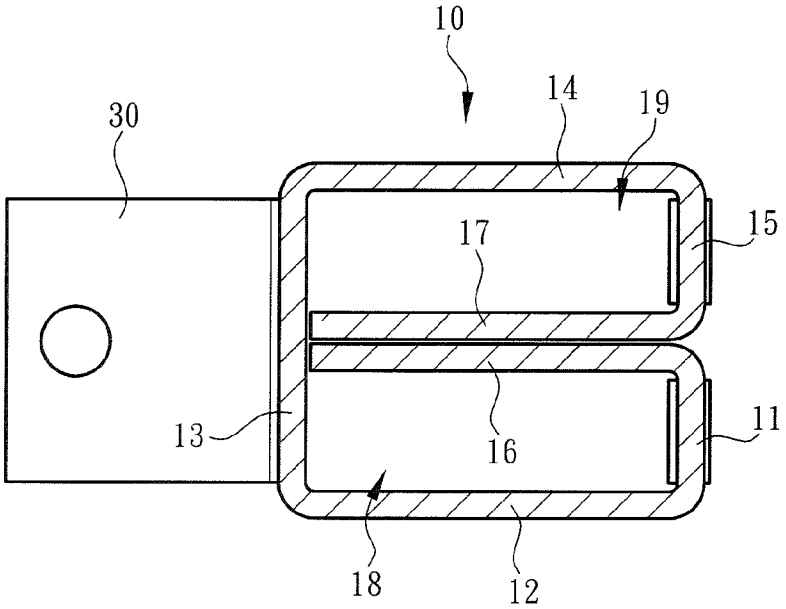
FIG. 7 is a sectional view of a modified embodiment of the present invention according to FIG. 6.

In comparison with FIGS. 5 and 6, FIG. 7 shows that the length of the first subsidiary side 16 is equal to the length of the second subsidiary side 17.

Figure 8:
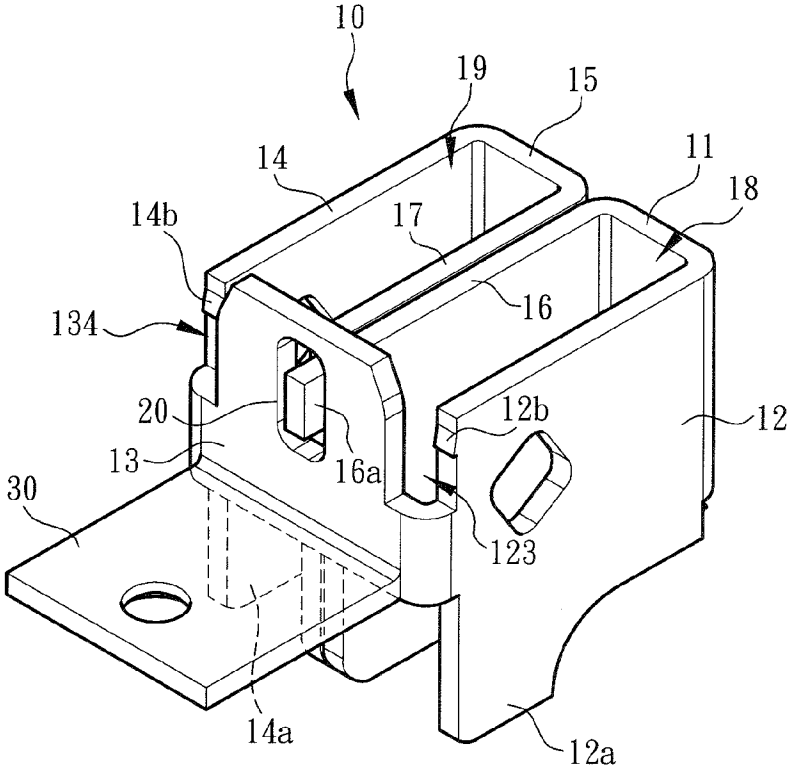
FIG. 8 is a perspective view of another embodiment of the electrical connector limiter of the present invention, showing that the third side is formed with an extension section.

Please refer to FIG. 8. In the limiter 10, the notch 123 is formed at a junction between (the upper end) of the second side 12 and (the upper end) of the third side 13 and the notch 134 is formed at a junction between the third side 13 and the fourth side 14. FIG. 8 also shows that the finger sections 12*b*, 14*b* are respectively formed on the lateral side of the upper end of the second side 12 in a position adjacent to the notch 123 and the lateral side of the upper end of the fourth side 14 in a position adjacent to the notch 134. The bottom end of the third side 13 is (perpendicularly) bent to form the extension section 30.

Figure 10:
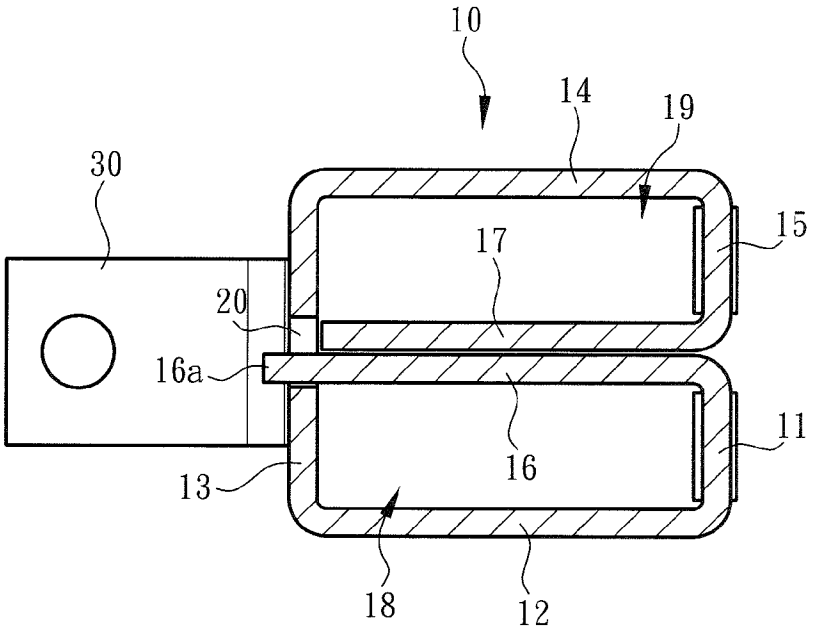
FIG. 10 is a sectional view according to FIG. 9.
Figure 9:
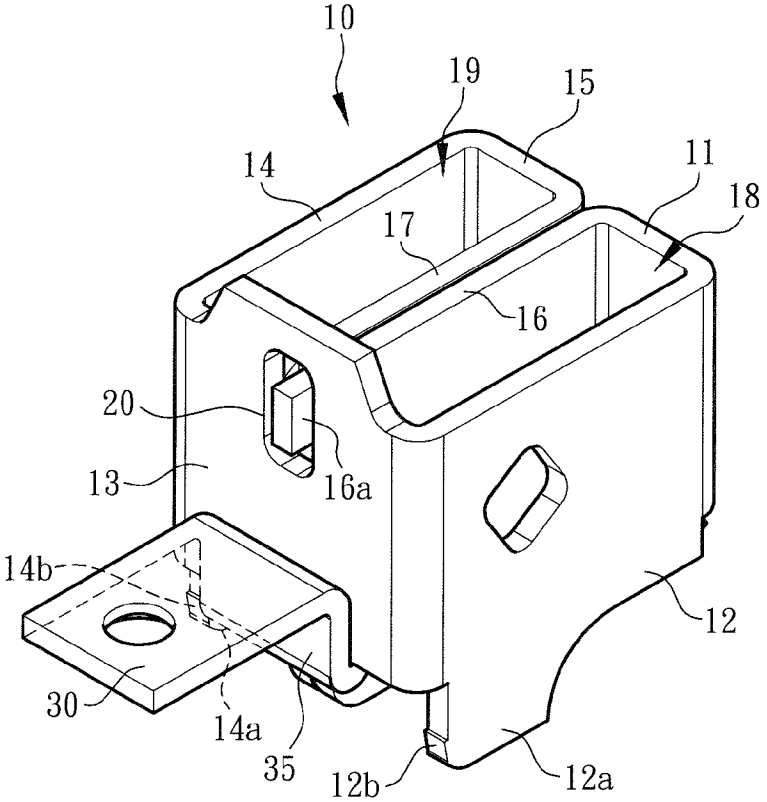
FIG. 9 is a perspective view of still another embodiment of the electrical connector limiter of the present invention, showing that the third side is formed with an extension section.

Please refer to FIGS. 9 and 10. In the limiter 10, the leg sections 12*a*, 14*a* are formed at the bottom ends of the second and fourth sides 12, 14 and the finger sections 12*b*, 14*b* are formed on (the lateral sides) of the leg sections 12*a*, 14*a*. In addition, the bottom end of the third side 13 is bent toward the upper side of the drawing to form a subsidiary section 35. The subsidiary section 35 is further bent to a horizontal position and extends to form the extension section 30.

Figure 11:
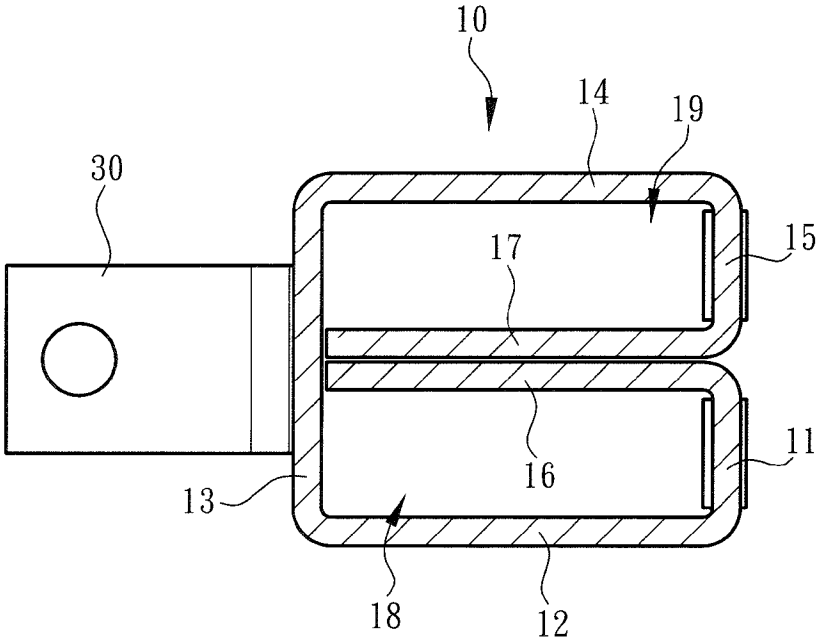
FIG. 11 is a sectional view of a modified embodiment of the present invention according to FIG. 10.

In comparison with FIGS. 9 and 10, FIG. 11 shows that the length of the first subsidiary side 16 is equal to the length of the second subsidiary side 17.

Figure 12:
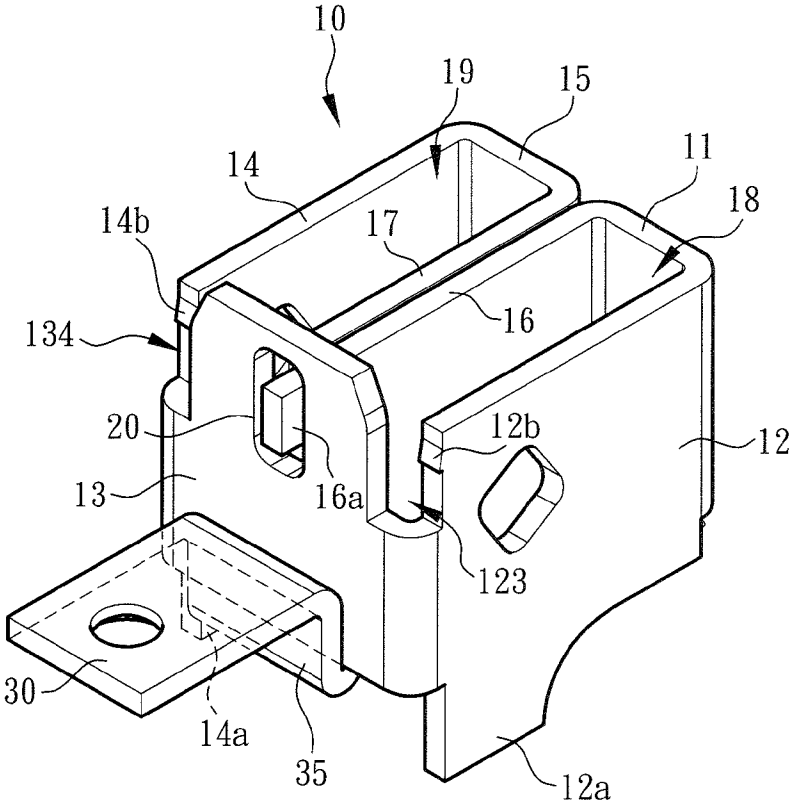
FIG. 12 is a perspective view of still another embodiment of the electrical connector limiter of the present invention, showing that the third side is formed with an extension section.

Please refer to FIG. 12. In the limiter 10, the notch 123 is formed at a junction between (the upper end) of the second side 12 and (the upper end) of the third side 13 and the notch 134 is formed at a junction between the third side 13 and the fourth side 14. FIG. 12 also shows that the finger sections 12*b*, 14*b* are respectively formed on the lateral side of the upper end of the second side 12 in a position adjacent to the notch 123 and the lateral side of the upper end of the fourth side 14 in a position adjacent to the notch 134. The bottom end of the third side 13 is bent toward the upper side of the drawing to form the subsidiary section 35. The subsidiary section 35 is further bent to a horizontal position and extends to form the extension section 30.

Figure 14:
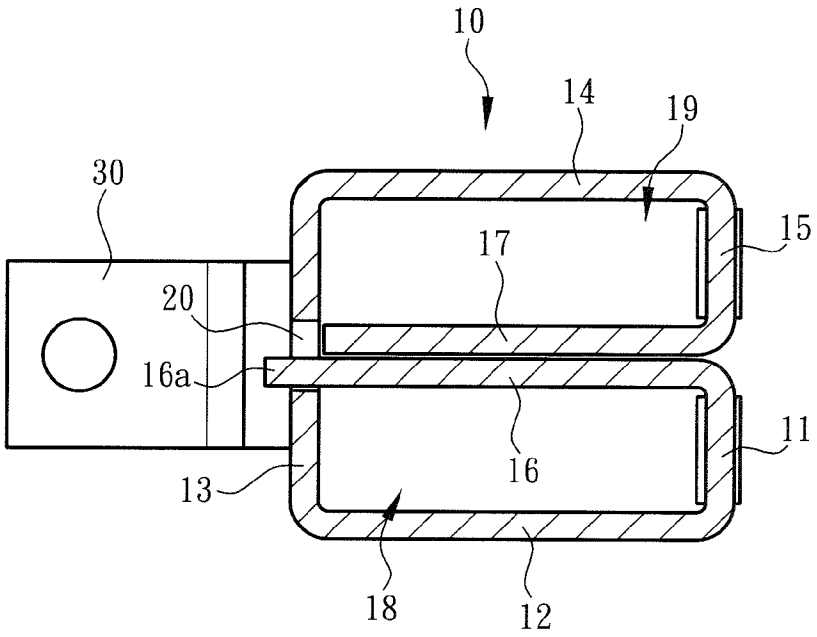
FIG. 14 is a sectional view according to FIG. 13.
Figure 13:
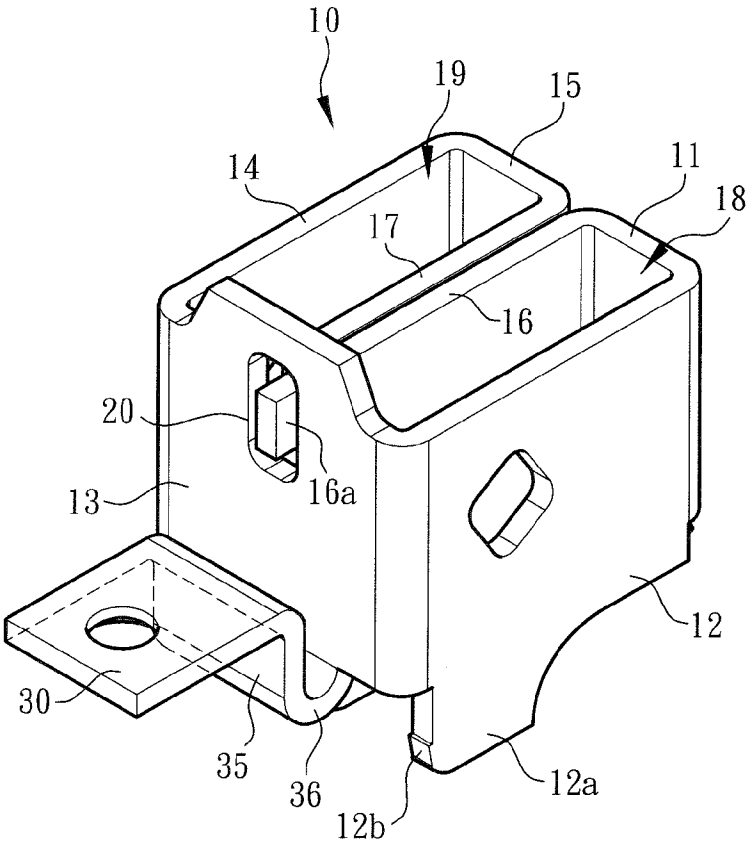
FIG. 13 is a perspective view of still another embodiment of the electrical connector limiter of the present invention, showing that the third side is formed with an extension section and the second and fourth sides are formed with the finger sections.

Please refer to FIGS. 13 and 14. In the limiter 10, the leg sections 12*a*, 14*a* are formed at the bottom ends of the second and fourth sides 12, 14 and the finger sections 12*b*, 14*b* are formed on (the lateral sides) of the leg sections 12*a*, 14*a*. In addition, the bottom end of the third side 13 is bent toward the upper side of the drawing to form an arched section 36 and a subsidiary section 35 connected with the arched section 36. The subsidiary section 35 is further bent to a horizontal position and extends to form the extension section 30.

Figure 15:
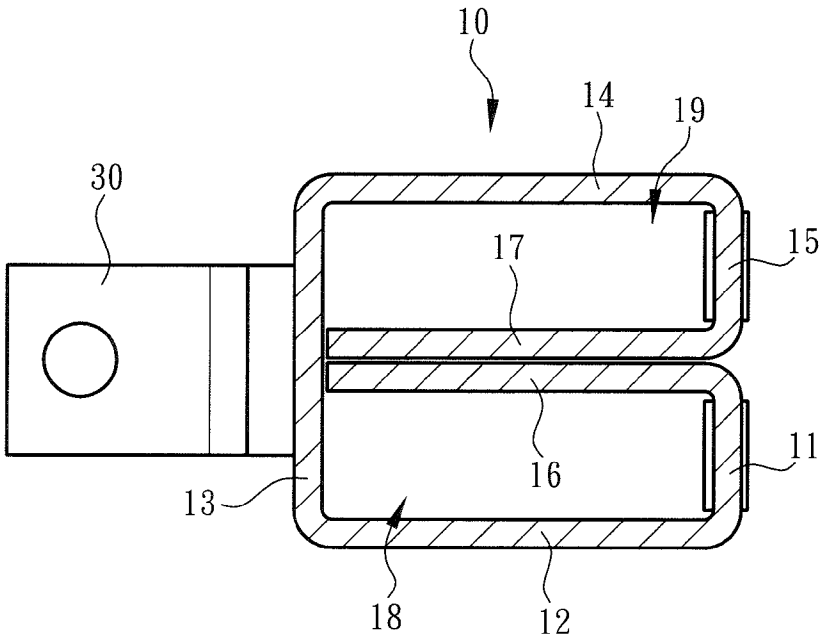
FIG. 15 is a sectional view of a modified embodiment of the present invention according to FIG. 13.

In comparison with FIGS. 13 and 14, FIG. 15 shows that the length of the first subsidiary side 16 is equal to the length of the second subsidiary side 17.

Figure 16:
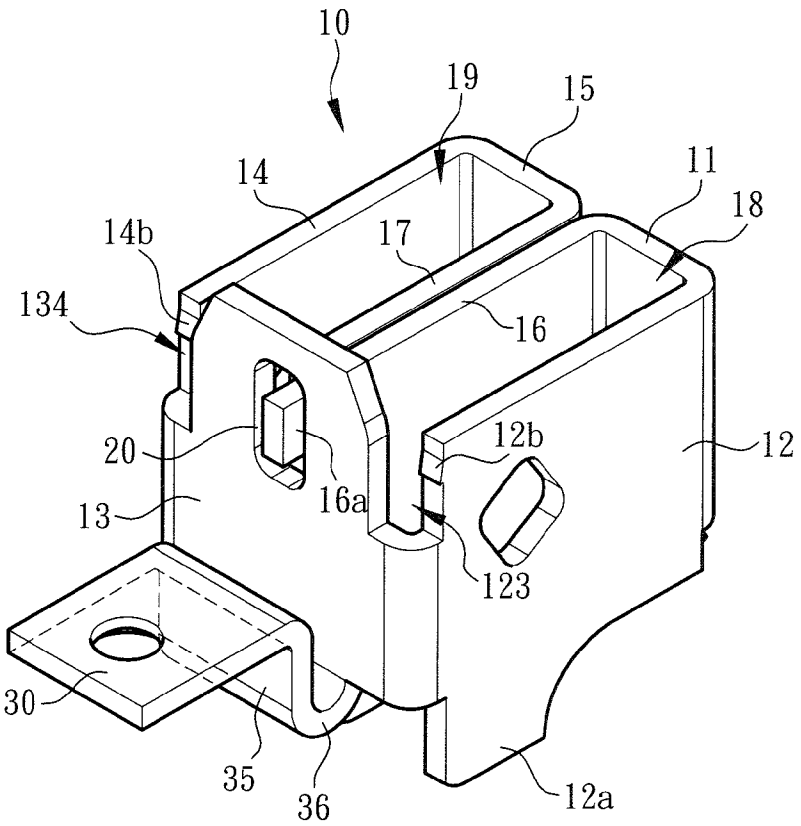
FIG. 16 is a perspective view of still another embodiment of the electrical connector limiter of the present invention, showing that a notch is formed at a junction between the second and third sides and another notch is formed at a junction between the third and fourth sides.

Please refer to FIG. 16. In the limiter 10, the notch 123 is formed at a junction between (the upper end) of the second side 12 and (the upper end) of the third side 13 and the notch 134 is formed at a junction between the third side 13 and the fourth side 14. FIG. 16 also shows that the finger sections 12*b*, 14*b* are respectively formed on the lateral side of the upper end of the second side 12 in a position adjacent to the notch 123 and the lateral side of the upper end of the fourth side 14 in a position adjacent to the notch 134. The bottom end of the third side 13 is bent toward the upper side of the drawing to form an arched section 36 and a subsidiary section 35 connected with the arched section 36. The subsidiary section 35 is further bent to a horizontal position and extends to form the extension section 30.

To speak representatively, in the condition that the trend to design miniaturized terminal device is satisfied and the volume of the terminal device is not increased, in comparison with the conventional terminal device, the electrical connector limiter structure of wire connection terminal of the present invention has the following advantages:

1. The limiter 10 and the relevant components and structures have been redesigned. For example, the limiter 10 includes a first side 11, a second side 12, a third side 13, a fourth side 14 and a fifth side 15. The first side 11 is bent to forma first subsidiary side 16. The fifth side 15 is bent to form a second subsidiary side 17 to together define a first space 18 and a second space 19 with a fully closed periphery as a frame structure for receiving and restricting the metal leaf springs. At least the first subsidiary side 16 (or the second subsidiary side 17) is formed with a protrusion end 16*a*. The protrusion end 16*a* passes through or enters the window 20 of the third side 13. In addition, the limiter 10 is formed with the notches 123, 134 and the finger sections 12*b*, 14*b*. The third side 13 is formed with an extension section 30 and/or the subsidiary side 35 and the arched section 36. The fixing structures or assembling relationship of the conventional electrical connector and metal leaf springs are changed and the present invention is obviously different from the conventional terminal device in use and operation form.

2. Especially, the limiter 10 has a first space 18 and a second space 19 with a fully closed periphery, whereby the limiter 10 has an ideal structural strength and is able to truly receive and restrict the moving path of the metal leaf springs. At least two conductive wires can be plugged into the limiter 10 or the electrical connector to respectively assemble with the metal leaf springs. Accordingly, the operation of an operator is facilitated and the limiter 10 is easy to manufacture. Also, the present invention improves the shortcomings of the conventional wire connection terminal that the operation is troublesome and time-consuming, the structure is relatively complicated, the metal bare end of the conductive wire is apt to thrust and damage the case or deflect the metal leaf springs or scrape and break the case and the holding is unstable. That is, the structural design of the limiter 10 apparently improves the shortcoming of the conventional wire connection terminal that the peripheries of the first and second spaces are not fully closed. Under such circumstance, when a first conductive wire is plugged into the conventional wire connection terminal, the limiter is apt to be compressed to lead to deformation of some sidewalls of the limiter. This will affect the plug-in operation of the second conductive wire. As a result, the normal (swinging) function and motional form of the metal leaf springs will be affected or interfered with. The present invention as minimizes the deformation of the sidewalls of the limiter as possible.

In conclusion, the electrical connector limiter structure of wire connection terminal of the present invention is different from the conventional wire connection terminal in space form and is advantageous over the conventional wire connection terminal. The electrical connector limiter structure of wire connection terminal of the present invention is greatly advanced and inventive.

The above embodiments are only used to illustrate the present invention, not intended to limit the scope thereof. Many modifications of the above embodiments can be made without departing from the spirit of the present invention.

What is claimed is:

1. An electrical connector limiter structure of wire connection terminal, comprising a limiter for receiving metal leaf springs and restricting moving path of the metal leaf springs, the limiter having a first side, a second side connected with the first side, a third side connected with the second side and a fourth side connected with the third side, the first side being bent toward the third side and extending to form a first subsidiary side, the first subsidiary side extending to a position in adjacency to the third side so as to define a first space with a fully closed periphery, the fourth side being bent toward the second side and extending to form a fifth side, the fifth side being bent toward the third side and extending to form a second subsidiary side, the second subsidiary side extending to a position in adjacency to the third side so as to define a second space with a fully closed periphery.

2. The electrical connector limiter structure of wire connection terminal as claimed in claim 1, wherein the first side and the first subsidiary side contain an angle selected from a group consisting of an acute angle, a right angle and an obtuse angle and the fifth side and the second subsidiary side contain an angle selected from a group consisting of an acute angle, a right angle and an obtuse angle, the first and second subsidiary sides being side by side arranged in parallel to each other.

3. The electrical connector limiter structure of wire connection terminal as claimed in claim 1, wherein the third side is formed with a window and at least one of the first and second subsidiary sides is formed with a protrusion end extending into the window.

4. The electrical connector limiter structure of wire connection terminal as claimed in claim 1, wherein the first subsidiary side has a length equal to a length of the second subsidiary side.

5. The electrical connector limiter structure of wire connection terminal as claimed in claim 3, wherein the protrusion end is formed on the first subsidiary side, whereby the total length of the first subsidiary side and the protrusion end is larger than the length of the second subsidiary side.

6. The electrical connector limiter structure of wire connection terminal as claimed in claim 1, wherein two leg sections respectively protrude from a bottom end of the second side and a bottom end of the fourth side and finger sections are respectively formed on lateral sides of the leg sections, one of an upper end and a lower end of the third side being perpendicularly bent to form an extension section.

7. The electrical connector limiter structure of wire connection terminal as claimed in claim 3, wherein two leg sections respectively protrude from a bottom end of the second side and a bottom end of the fourth side and finger sections are respectively formed on lateral sides of the leg sections, one of an upper end and a lower end of the third side being perpendicularly bent to form an extension section.

8. The electrical connector limiter structure of wire connection terminal as claimed in claim 4, wherein two leg sections respectively protrude from a bottom end of the second side and a bottom end of the fourth side and finger sections are respectively formed on lateral sides of the leg sections, one of an upper end and a lower end of the third side being perpendicularly bent to form an extension section.

9. The electrical connector limiter structure of wire connection terminal as claimed in claim 5, wherein two leg sections respectively protrude from a bottom end of the second side and a bottom end of the fourth side and finger sections are respectively formed on lateral sides of the leg sections, one of an upper end and a lower end of the third side being perpendicularly bent to form an extension section.

10. The electrical connector limiter structure of wire connection terminal as claimed in claim 1, wherein a notch is formed at a junction between an upper end of the second side and an upper end of the third side and another notch is formed at a junction between the third side and the fourth side, a finger section being formed on a lateral side of the upper end of the second side in a position adjacent to the notch between the second and third sides, another finger section being formed on a lateral side of the upper end of the fourth side in a position adjacent to the notch between the third side and the fourth side, one of an upper end and a lower end of the third side being perpendicularly bent to form an extension section.

11. The electrical connector limiter structure of wire connection terminal as claimed in claim 3, wherein a notch is formed at a junction between an upper end of the second side and an upper end of the third side and another notch is formed at a junction between the third side and the fourth side, a finger section being formed on a lateral side of the upper end of the second side in a position adjacent to the notch between the second and third sides, another finger section being formed on a lateral side of the upper end of the fourth side in a position adjacent to the notch between the third side and the fourth side, one of an upper end and a lower end of the third side being perpendicularly bent to form an extension section.

12. The electrical connector limiter structure of wire connection terminal as claimed in claim 4, wherein a notch is formed at a junction between an upper end of the second side and an upper end of the third side and another notch is formed at a junction between the third side and the fourth side, a finger section being formed on a lateral side of the upper end of the second side in a position adjacent to the notch between the second and third sides, another finger section being formed on a lateral side of the upper end of the fourth side in a position adjacent to the notch between the third side and the fourth side, one of an upper end and a lower end of the third side being perpendicularly bent to form an extension section.

13. The electrical connector limiter structure of wire connection terminal as claimed in claim 5, wherein a notch is formed at a junction between an upper end of the second side and an upper end of the third side and another notch is formed at a junction between the third side and the fourth side, a finger section being formed on a lateral side of the upper end of the second side in a position adjacent to the notch between the second and third sides, another finger section being formed on a lateral side of the upper end of the fourth side in a position adjacent to the notch between the third side and the fourth side, one of an upper end and a lower end of the third side being perpendicularly bent to form an extension section.

14. The electrical connector limiter structure of wire connection terminal as claimed in claim 6, wherein the bottom end of the third side is bent upward to form a subsidiary section and the subsidiary section is bent to a horizontal position and extends to form the extension section.

15. The electrical connector limiter structure of wire connection terminal as claimed in claim 7, wherein the bottom end of the third side is bent upward to form a subsidiary section and the subsidiary section is bent to a horizontal position and extends to form the extension section.

16. The electrical connector limiter structure of wire connection terminal as claimed in claim 8, wherein the bottom end of the third side is bent upward to form a subsidiary section and the subsidiary section is bent to a horizontal position and extends to form the extension section.

17. The electrical connector limiter structure of wire connection terminal as claimed in claim 9, wherein the bottom end of the third side is bent upward to form a subsidiary section and the subsidiary section is bent to a horizontal position and extends to form the extension section.

18. The electrical connector limiter structure of wire connection terminal as claimed in claim 10, wherein the bottom end of the third side is bent upward to form a subsidiary section and the subsidiary section is bent to a horizontal position and extends to form the extension section.

19. The electrical connector limiter structure of wire connection terminal as claimed in claim 11, wherein the bottom end of the third side is bent upward to form a subsidiary section and the subsidiary section is bent to a horizontal position and extends to form the extension section.

20. The electrical connector limiter structure of wire connection terminal as claimed in claim 14, wherein the bottom end of the third side is bent upward to form an arched section, the arched section being connected with the subsidiary section.

21. The electrical connector limiter structure of wire connection terminal as claimed in claim 15, wherein the bottom end of the third side is bent upward to form an arched section, the arched section being connected with the subsidiary section.

22. The electrical connector limiter structure of wire connection terminal as claimed in claim 16, wherein the bottom end of the third side is bent upward to form an arched section, the arched section being connected with the subsidiary section.

23. The electrical connector limiter structure of wire connection terminal as claimed in claim 17, wherein the bottom end of the third side is bent upward to form an arched section, the arched section being connected with the subsidiary section.

24. The electrical connector limiter structure of wire connection terminal as claimed in claim 18, wherein the bottom end of the third side is bent upward to form an arched section, the arched section being connected with the subsidiary section.

25. The electrical connector limiter structure of wire connection terminal as claimed in claim 19, wherein the bottom end of the third side is bent upward to form an arched section, the arched section being connected with the subsidiary section.

* * * * *